United States Patent [19]

Shore

[11] 4,301,957

[45] Nov. 24, 1981

[54] RIBBON CARTRIDGE

[76] Inventor: Sydney Shore, 38-40 48th St., Long Island City, N.Y. 11004

[21] Appl. No.: 176,744

[22] Filed: Aug. 11, 1980

[51] Int. Cl.[3] ..... B65H 17/42

[52] U.S. Cl. ..... 226/118

[58] Field of Search ..... 226/118, 119, 89, 90, 226/187; 242/197, 55.19 R, 55.19 A

[56] References Cited

U.S. PATENT DOCUMENTS

| | | | |
|---|---|---|---|
| 3,048,315 | 8/1962 | Ponkratz | 226/118 |
| 3,534,894 | 10/1970 | Bretti | 226/187 |
| 3,543,983 | 12/1970 | Dale | 226/118 |
| 3,752,379 | 8/1973 | Padova | 226/119 |
| 4,045,821 | 8/1977 | Fujikura | 242/197 |

*Primary Examiner*—Edward J. McCarthy

*Attorney, Agent, or Firm*—Sprung, Felfe, Horn, Lynch & Kramer

[57] ABSTRACT

A ribbon cartridge of the type having a body portion wherein an endless ribbon is contained in a fan-folded condition during use, includes a removable partition which is extendable entirely across and through the body portion between the inlet and outlet apertures thereof for separating the body portion into a first compartment at the outlet aperture side wherein the ribbon can be contained in a fan-folded condition prior to the first use of the cartridge and the second compartment at the inlet aperture side and including the entire drive aperture of the cartridge.

5 Claims, 3 Drawing Figures

RIBBON CARTRIDGE

BACKGROUND OF THE INVENTION

The present invention relates to ribbon cartridges and in particular, ribbon cartridges of the type having a body portion wherein an endless ribbon is contained in a fanfold condition during use.

Ribbon cartridges of this type have been used in increasing numbers especially in point of sales machines wherein continuous use is required with infrequent ribbon changes, conditions which are met by endless fabric ribbons stored in cartridges.

As will be explained in more detail with respect to FIG. 1, prior art ribbon cartridges of this type are initially provided with an endless ribbon rolled up in a spool and which after repeated use in a printer, works itself into the fan-folded state similar to that shown in FIG. 2. However, due to the fact that the ribbon cartridge must be provided with a substantially large aperture in one main wall thereof in order to allow for the driving of the ribbon during use, it is important that the ribbon not approach the drive aperture so as to prevent the inadvertent removal of the ribbon therethrough.

In the prior art, a removable cardboard member is provided which has arms extending through the drive aperture and which bears against the ribbon spool to prevent its falling through the drive aperture.

The disadvantage of the prior art device is that it is flimsy in construction and is suitable only for holding the ribbon when in a wound configuration. Further, the use of the ribbon in the initial wound state is found to jam-up during its transformation from the wound state to the fan-folded state and thus, while it is more desirable to initially provide the ribbon in the fan-folded state, it is impossible to do so with the construction in the prior art.

SUMMARY OF THE INVENTION

The main object of the present invention is to eliminate the disadvantages of the prior art cartridges and provide a cartridge of the type initially described which has the ribbon in an initial fan-folded condition prior to the first use thereof and which reliably holds same in this condition until the ribbon is installed in the printer for use.

These and other objects of the present invention are achieved according to the present invention by removable partitioning means which is extendable entirely across and through the body portion of the ribbon cartridge between the inlet and outlet apertures thereof for separating the body portion into a first compartment at the outlet aperture side wherein the ribbon can be contained in a fan-folded condition prior to the first use of the cartridge and the second compartment at the inlet aperture side including the entire drive aperture.

The partitioning means according to the present invention preferably comprises a first slot in a first side wall between the inlet and outlet apertures and a second slot in a second side wall opposite the first side wall and an elongated partition member which is slidably received through the two slots.

The partition member preferably comprises a tab portion to enable the removal thereof from the cartridge after the loading of the cartridge and before use. In a particularly advantageous commercial embodiment of the present invention, the partition member and tab are of unitary and integral construction and made out of cardboard material.

The present invention will be explained in more detail by way of examples with respect to the attached drawings wherein:

DETAILED DESCRIPTION OF THE INVENTION

Figures 1, 2, 3:
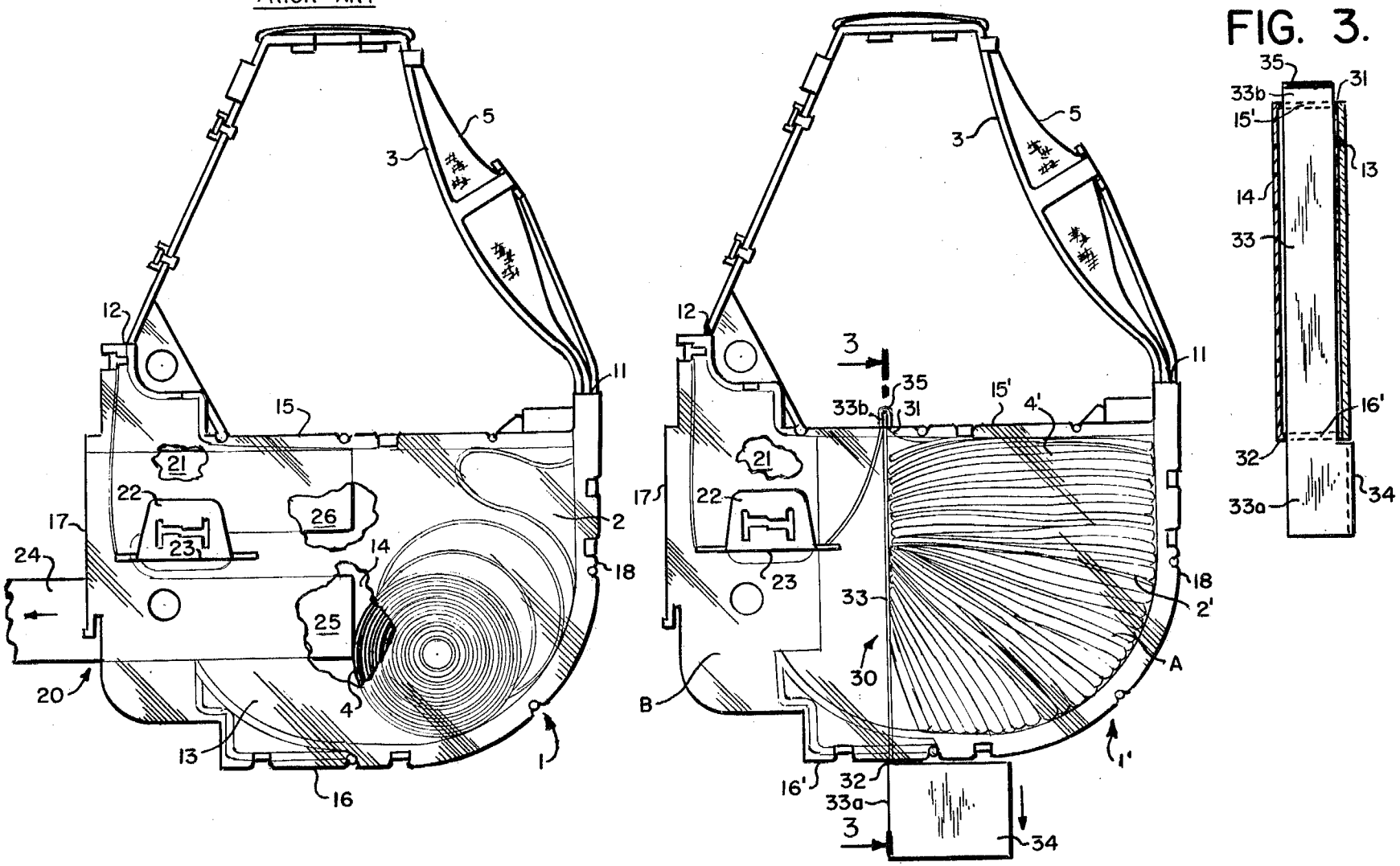
FIG. 1. PRIOR ART
FIG. 1 is a top view of a prior art ribbon cartridge.
FIG. 2 is a top view of the ribbon cartridge according to the present invention.
FIG. 3 is a sectional view along line 3—3 in FIG. 2.

Referring now to FIG. 1, a well known ribbon cartridge is shown so as to explain the prior art and to give a better understanding of the improvement of the present invention.

The ribbon cartridge 1 includes a body portion 2 in which an endless ribbon 4 is contained in the wound state. The cartridge 1 also includes a guide portion 3 for a run 5 of the ribbon which exits the body portion to an outlet aperture 11 in side wall 15 and enters the body portion 2 again through inlet aperture 12 in side wall 15.

The body portion 2 also includes an upper main wall 13 and a lower main wall 14 with side walls 15, 16, 17 and 18 disposed therebetween.

At the inlet aperture side of the body portion, there is a drive aperture 21 in lower main wall 26 which exposes a ribbon holding device 22 having a run 23 of ribbon therethrough and which enables a printer to drive the ribbon during use.

The ribbon 4 is initially in the wound state as shown in FIG. 1, however, as it is used and subsequently driven back into the body portion via the ribbon guiding mechanism 22, the ribbon 4 assumes the fan-folded condition and remains in this condition throughout its further use.

When the ribbon cartridge 1 shown in FIG. 1 is initially packaged for sale, in order to prevent the wound ribbon 4 from slipping out through the drive aperture 21 and thus rendering the cartridge unfit for use, a member 20 is provided having two arm portions 25, 26 which extend through the aperture 21 and into the body portion of the cartridge so as to bear against the wound ribbon 4 and prevent its inadvertent falling out. A tab portion 24 is connected to the arms 25, 26 and extends outwardly of the cartridge to enable the removal of the barrier member 20 prior to the installation of the cartridge in the printing mechanism.

It is important to note that the member 20 must be removed prior to installation, since it would clearly interfere with the drive mechanism of the printer and thus would not permit the insertion of the ribbon in the printer.

Referring now to FIGS. 2 and 3, the present invention will be described and wherein the same numerical labels are utilized to identify common elements.

Accordingly, the present invention includes partitioning means 30 which enables the body portion 2′ of the ribbon cartridge 1′ to be separated into a first compartment A at the outlet aperture side of the body portion 2′ wherein the ribbon 4′ can be contained in a fan-folded condition as shown, prior to the first use of the cartridge 1′ and a second compartment B at the inlet aperture side and including the entire drive aperture 21.

The removable partitioning means 30 comprises partitioning member 33 which extends entirely across and through the body portion 2' between the inlet and outlet apertures 12, 11 by means of slot 31 in side wall 15' and slot 32 in side wall 16' which slidably receive the partition member 33 as shown.

Due to the fact that the ribbon 4' is a continuous ribbon, the slot 31 must be configured to receive the end portion **33*b* of partition member 33 along with a run 35 of the ribbon 4'**. This also acts to reliably maintain the ribbon in a locked condition so that it cannot be inadvertently pulled out of the cartridge at the inlet aperture side.

The slots 31, 32 are preferably aligned so as to dispose the partition member 33 substantially perpendicular to side walls 15', 16'. The partition member 33 is preferably elongated and configured to have the portion **33*b* extending outwardly from slot 31 and the end portion 33*a* extending outwardly from slot 32 when in position. The partition member also includes a tab 34 to enable the gripping of the partition member 33 for its removal. The tab 34 and partition member 33** are preferably of an integral and unitary construction and preferably are made from cardboard material.

The tab 34 also provides a useful surface for the printing of instructions for the removal of the partition member as will be explained hereinafter.

The partitioning means 30 of the present invention are particularly useful in that it permits the initial loading of the cartridge 1' with the ribbon 4' in the fan-folded condition as shown in FIG. 2. Furthermore, because the partitioning means does not in any way interfere with or cover the drive aperture 21, the cartridge can be placed in the machine in the loaded condition and thereafter the partition member 33 is removed. In this way, the drive mechanism of the machine which extends through the drive aperture 21, provides a natural barrier to prevent the inadvertent escape of the ribbon 4' from the body portion 2' of the cartridge 1'.

It will be appreciated that the instant specification and claims are set forth by way of illustration and not limitation, and that various modifications and changes may be made without departing from the spirit and scope of the present invention.

What is claimed is:

1. In a ribbon cartridge of the type having a body portion wherein an endless ribbon is contained in a fan-folded condition during use, the body portion having spaced apart inlet and outlet apertures for the entry and exit of a run of ribbon and a drive aperture in one main wall adjacent the inlet aperture to permit the driving of the ribbon during use, the improvement comprising: removable partitioning means extendable entirely across and through the body portion between the inlet and outlet apertures for separating the body portion into a first compartment at the outlet aperture side wherein the ribbon can be contained in a fan-folded condition prior to the first use of the cartridge and a second compartment at the inlet aperture side including the entire drive aperture.

2. The ribbon cartridge according to claim 1, wherein the body portion comprises upper and lower main walls, a first side wall therebetween having the inlet and outlet apertures therein and a second side wall opposite the first side wall, the removable partitioning means comprises a first slot in the first side wall between the inlet and outlet apertures, a second slot in the second side wall aligned with the first slot and an elongated partition member slidably received through the two slots.

3. The ribbon cartridge according to claim 2, wherein the partition member further comprises a tab portion to enable the removal of the partition member from the cartridge after the loading of the cartridge and before use.

4. The ribbon cartridge according to claim 1, wherein the partition member and tab comprise a unitary and integral member.

5. The ribbon cartridge according to claim 4, wherein the partition member comprises cardboard material.

* * * * *